US006790481B2

(12) United States Patent
Bishop et al.

(10) Patent No.: US 6,790,481 B2
(45) Date of Patent: Sep. 14, 2004

(54) CORROSION-RESISTANT HEAT EXCHANGER

(75) Inventors: Charles J. Bishop, Grafton, WI (US); Ming C. Kuo, Fox Point, WI (US)

(73) Assignee: AOS Holding Company, Wilmington, DE (US)

( * ) Notice: Subject to any disclaimer, the term of this patent is extended or adjusted under 35 U.S.C. 154(b) by 0 days.

(21) Appl. No.: 10/347,816

(22) Filed: Jan. 21, 2003

(65) Prior Publication Data

US 2003/0106676 A1 Jun. 12, 2003

Related U.S. Application Data

(62) Division of application No. 09/973,262, filed on Oct. 9, 2001.

(51) Int. Cl.[7] ..... B05D 1/18

(52) U.S. Cl. ..... 427/436; 427/437; 427/438; 427/443.1; 205/191

(58) Field of Search ..... 427/436, 437, 427/438, 443.1; 205/191

(56) References Cited

U.S. PATENT DOCUMENTS

| | | | | |
|---|---|---|---|---|
| 2,532,283 A | | 12/1950 | Brenner et al. | |
| 3,612,004 A | | 10/1971 | Cancilla | 122/230 |
| 3,727,680 A | | 4/1973 | Henry, Jr. | |
| 4,054,174 A | | 10/1977 | Haller | |
| 4,060,988 A | | 12/1977 | Arnold | |
| 4,134,451 A | | 1/1979 | Conant et al. | |
| 4,268,586 A | | 5/1981 | Hanneman et al. | |
| 4,271,789 A | | 6/1981 | Black | 122/14.22 |
| 4,397,812 A | * | 8/1983 | Mallory, Jr. | 420/441 |
| 4,444,156 A | * | 4/1984 | Iwasaki et al. | 122/20 B |
| 4,730,666 A | * | 3/1988 | Flint et al. | 165/80.4 |
| 4,936,260 A | | 6/1990 | Adams | 122/18.31 |
| 4,946,458 A | | 8/1990 | Harms et al. | |
| 5,022,462 A | | 6/1991 | Flint et al. | |
| 5,219,815 A | * | 6/1993 | Krulik et al. | 502/200 |
| 5,220,887 A | | 6/1993 | Hiddleston et al. | |
| 5,228,413 A | | 7/1993 | Tam | 122/15.1 |
| 5,516,278 A | | 5/1996 | Morrison | |
| 5,687,678 A | | 11/1997 | Suchomel et al. | 122/250 R |
| 5,735,237 A | | 4/1998 | Phillip et al. | |
| 5,897,965 A | * | 4/1999 | Itoh et al. | 428/652 |
| 6,513,581 B1 | | 2/2003 | Hüffer et al. | |

FOREIGN PATENT DOCUMENTS

| | | | | |
|---|---|---|---|---|
| JP | 359200153 | | 11/1984 | |
| JP | 61-291979 A | * | 12/1986 | C23C/18/32 |
| JP | 0091796 A | | 4/1987 | 165/134.1 |
| JP | 63213797 | | 9/1988 | 165/134.1 |

OTHER PUBLICATIONS

PVI NICKELSHIELD (R) Factsheet brochure distributed in 1983 and since.*

Sheets 1–5 taken from the PVI Industries, LLC website depicting the Electroless Nickel Plating and its NICKELSHIELD® plating process which has been in commercial use for over 39 years.

(List continued on next page.)

*Primary Examiner*—Michael Barr
(74) *Attorney, Agent, or Firm*—Michael Best & Friedrich LLP

(57) ABSTRACT

A corrosion-resistant, copper-finned heat exchanger for a water heater is provided. The heat exchanger includes a conduit through which water runs, heat-transfer fins extending from the conduit and an anti-corrosive coating containing electroless nickel. The heat-transfer fins contain copper, and the coating is deposited directly onto at least one of the copper heat-transfer fins.

27 Claims, 3 Drawing Sheets

OTHER PUBLICATIONS

PVI NICKELSHIELD® Factsheet brochure distributed in 1983 and since.

PVI NICKELSHIELD® Atmospheric Gas Sample Specification from 1988.

PVI NICKELSHIELD®TURBOPOWER® Gas Sample Specification from 1988.

PVI NICKELSHIELD® descriptive literature from a 1988 catalogue.

Electroless Nickel Plating of Louisiana, www.enla.com/applications_.html, copyright 1988, dated Jun. 19, 2003.

Electro–Coatings, Inc. Kanigen® Electroless Nickel, www.platingforindustry.com/electrocoatings/kantech.htm, copyright 2002, dated Jun. 19, 2003.

Union Hard Chromium Co., Inc., www.unionhardchromium.com/plating1.htm, Electroless Nickel, dated Jun. 19, 2003.

Hikifune, Functional Plating, www.hikifune.com/english/product/kino/kino.html, modified Apr. 30, 1997, dated Jun. 19, 2003.

Imagineering Enterprises, Inc., Meta Finishing Solutions, Electroless Nickel, www.imagineering–inc.com/solutions/electroless6.html, copyright 2002, dated Jun. 19, 2003.

A.O. Smith, Legend 2000 Burkay Boiler, World's best engineered high efficieny gas boiler, A.O. Smith Corporation, Form No. AOSC60847, 20M–MSI–991, Printed in U.S.A. before Oct. 9, 2001.

* cited by examiner

CORROSION-RESISTANT HEAT EXCHANGER

CROSS-REFERENCE TO RELATED APPLICATIONS

This application is a divisional and claims the benefit of priority of U.S. utility application Ser. No. 09/973,262 filed on Oct. 9, 2001. The subject matter of this utility application is hereby fully incorporated by reference.

BACKGROUND OF THE INVENTION

The invention relates to a coiled-heat-exchanger-type water heater, and more specifically to a corrosion-resistant coating for the heat exchanger coil of that type of water heater. The anti-corrosive coatings and coating methods described herein are also applicable to linear-heat-exchanger-type water heaters.

In known coiled-heat-exchanger-type water heaters, such as a Legend Burkay® Boiler manufactured by A. O. Smith Corporation headquartered in Milwaukee, Wis., water flows through the heat exchanger while hot products of combustion flow over the outside of the heat exchanger. If the water in the heat exchanger is too cold, some of the gases in the products of combustion may reach their dew points and condense on the heat exchanger. As a result, a condensation of corrosive-combustion products may form on the heat exchanger, thereby leading to corrosion of the coil. This, in turn, may cause inefficiencies in, or even failure of (i.e., leaking), the heat exchanger. More particularly, the corrosion products can accumulate on and between heat-transfer or finned surfaces extending from the heat exchanger, thereby resulting in restricted airflow through the heat exchanger. The restricted airflow can cause problems with combustion and also cause eventual leakage of the heat exchanger.

One known way to prevent corrosion in the heat exchanger is to coat the heat exchanger with lead. The typical process for this measure includes dipping the heat exchanger into a molten pool of lead to obtain complete coating of the heat exchanger. This process is typically no longer used due to the hazards associated with lead.

Another known way to combat such corrosion is to raise the temperature of the water being introduced into the heat exchanger to reduce the likelihood of condensation. This is sometimes done by routing or recirculating some of the hot water from the exit of the heat exchanger back to the inlet to mix with the cold water being introduced, thereby raising the temperature of the coil above the dew point. Such recirculation systems often require a pump and control system which can add cost and complexity to the system.

SUMMARY OF THE INVENTION

The invention provides a copper-finned heat exchanger for a water heater. The heat exchanger comprises a conduit through which water runs, heat-transfer fins extending from the conduit and an anti-corrosive coating comprising electroless nickel. The heat-transfer fins are made preferably of copper, and the coating is deposited directly onto at least one of the copper heat-transfer fins. In one embodiment of the invention, the anti-corrosive coating is about 0.05 mils to about 10 mils in thickness.

In addition, the invention provides a water heater. The water heater comprises a housing, a combustor positioned within the housing, a flue positioned above the combustor in the housing and a copper-coiled heat exchanger positioned within the housing. The heat exchanger has a conduit through which water runs, and heat-transfer fins extend therefrom. An anti-corrosive coating is chemically deposited directly onto a portion of the copper heat exchanger, and the anti-corrosive coating preferably includes electroless nickel. The anti-corrosive coating may be about 0.05 mils to about 10 mils in thickness.

Furthermore, the invention provides a method of preventing corrosion of a heat exchanger for a water heater. The method comprises immersing a copper heat exchanger into an aqueous-chemical-deposition bath comprising at least one of nickel, cobalt, palladium or platinum. The method further comprises electroless-chemically depositing an electroless coating selected from the group consisting of nickel, cobalt, palladium, platinum or a combination thereof onto at least a portion of the heat exchanger. The electroless coating prevents corrosion of the heat exchanger when the heat exchanger is used in conjunction with a functioning water heater.

Other features and advantages of the invention will become apparent to those skilled in the art upon review of the following detailed description, claims, and drawings.

Figure 1:
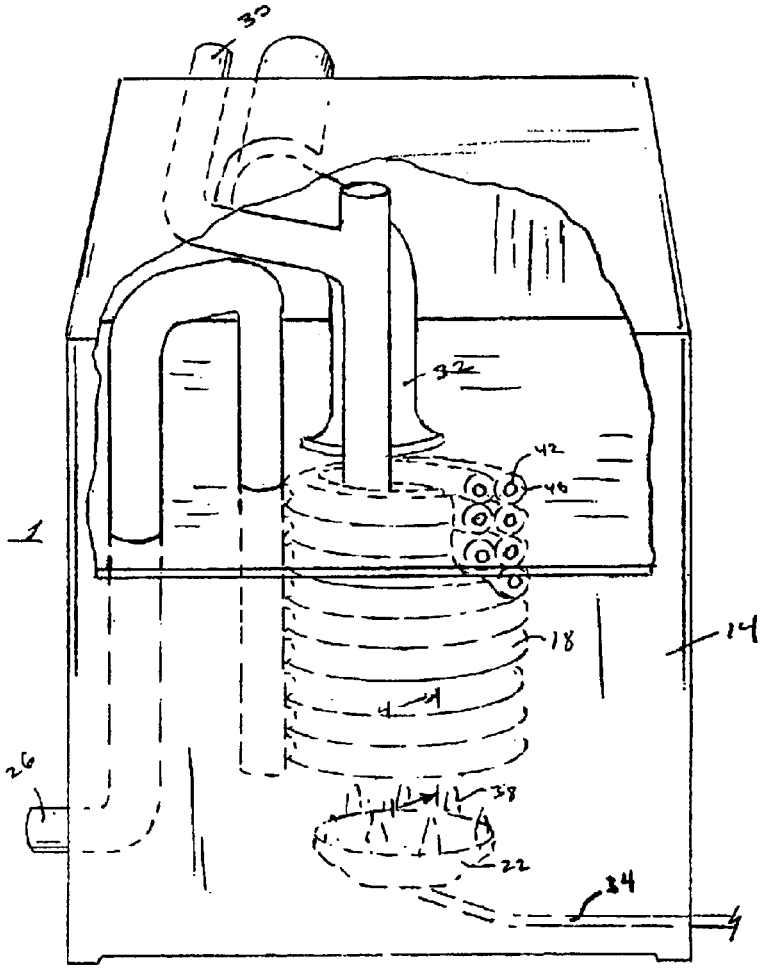
FIG. 1 is a perspective view of a water heater and a coiled heat exchanger (shown in phantom) embodying the present invention.
Figure 7:
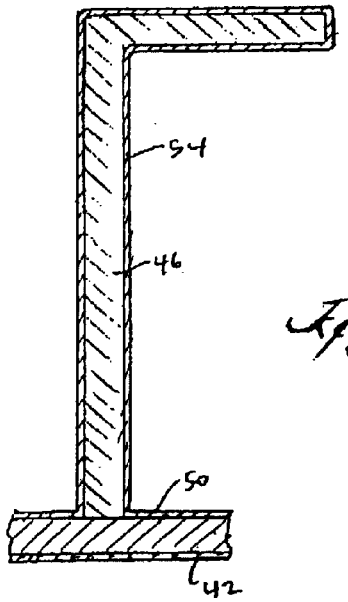
FIG. 7 is a greatly expanded cross-sectional view taken along line 7—7 of FIG. 4.
Figure 2:
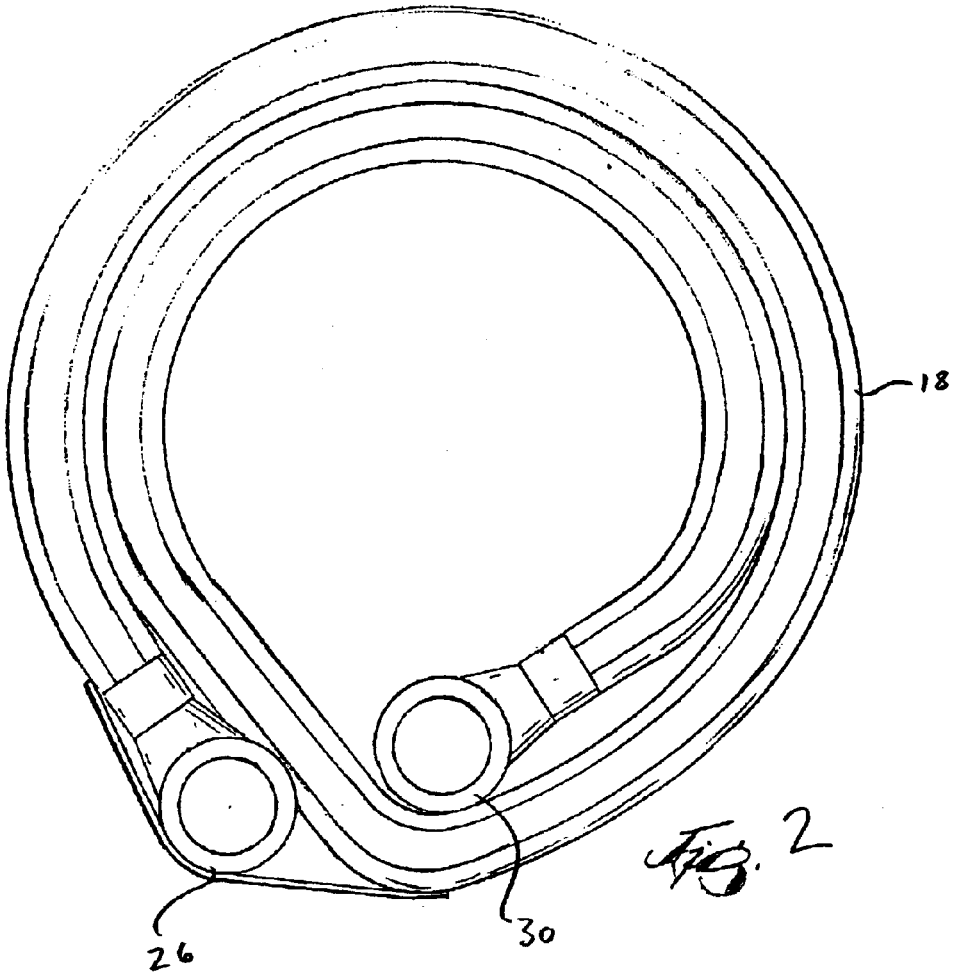
FIG. 2 is a top plan view of the coiled heat exchanger of the water heater in FIG. 1.
Figure 3:
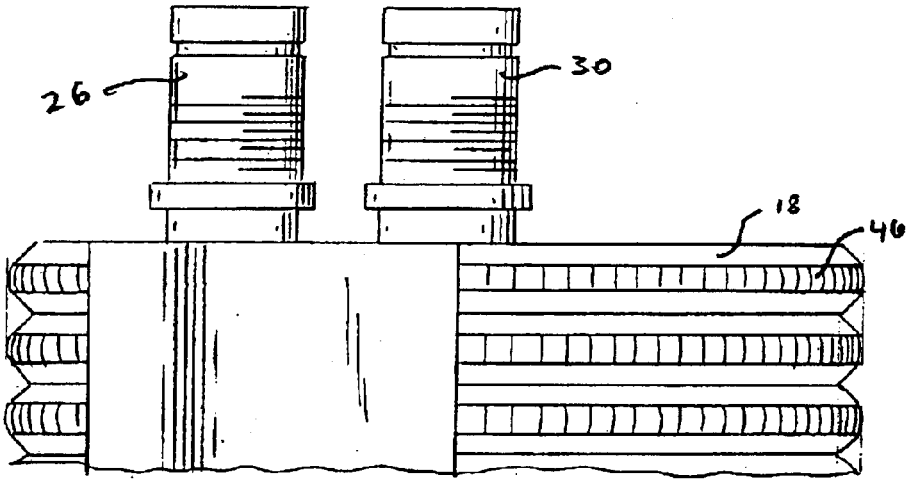
FIG. 3 is a side view of the top portion of the coiled heat exchanger in the water heater in FIG. 1.
Figure 5:
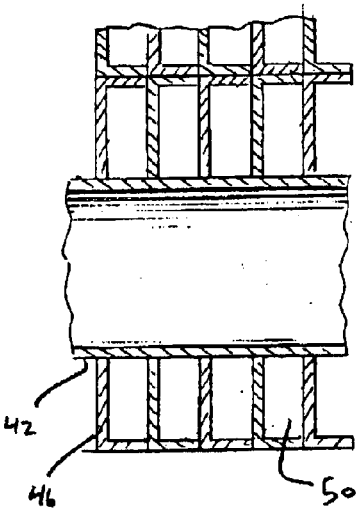
FIG. 5 is a cross-sectional view taken along line 5—5 of FIG. 4.
Figure 4:
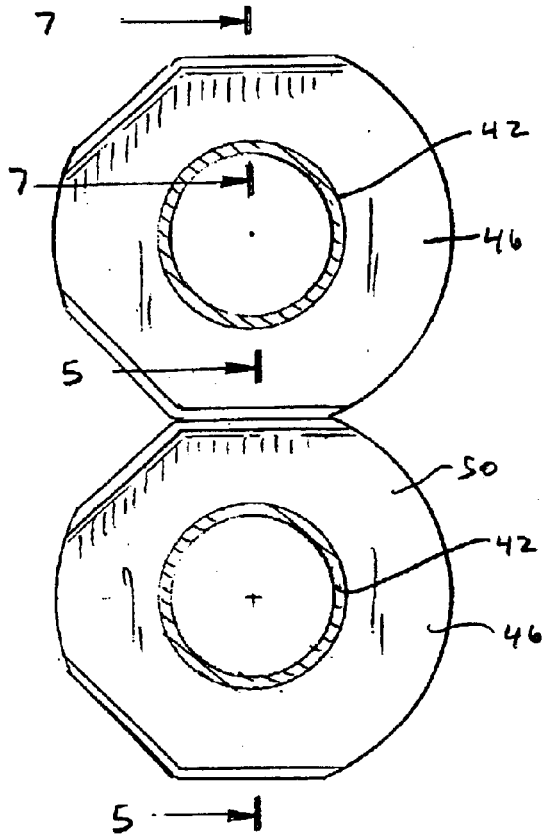
FIG. 4 is a partial cross-sectional view taken along line 4—4 of FIG. 1.
Figure 6:
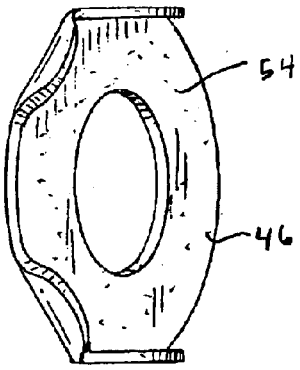
FIG. 6 is a perspective view of one of the heat-transfer fins of FIG. 5.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The use of "consisting of" and variations thereof herein is meant to encompass only the items listed thereafter. The use of letters to identify elements of a method or process is simply for identification and is not meant to indicate that the elements should be performed in a particular order.

DETAILED DESCRIPTION OF THE INVENTION

FIG. 1 illustrates a water heater 10 including a housing 14, a coiled heat exchanger 18 within the housing, and a combustor 22 positioned within the housing. Again, linear-type heat exchangers may be used, but coiled heat exchangers, and more particularly copper-coiled heat exchangers, are preferred. A cold-water inlet 26 extends through the housing 14 and communicates with one end of the coiled heat exchanger 18, and a hot-water outlet 30 extends through the housing 14 and communicates with the other end of the coiled heat exchanger 18. A gas-fuel supply line 34 communicates with the combustor 22 and provides gas fuel to be mixed with air and burned by the combustor 22. In operation, the combustor 22 creates hot products of combustion 38 by burning the air/fuel mixture and the hot products of combustion 38 flow over the coiled heat exchanger 18 to heat the water flowing therethrough. The hot products of combustion exit the water heater 10 through a flue 32. Therefore, cold water can be introduced into the cold-water inlet 26 and be heated as it flows through the coiled heat exchanger 18 such that the water is at a desired temperature as it exits through the hot-water outlet 30.

FIGS. 2–7 better illustrate the coiled heat exchanger 18, which includes a coiled-heat-exchange conduit, tube, or pipe 42 having heat-transfer fins 46 metallurgically bonded to its outer surface. A flow space 50 is defined between the fins to accommodate the flow of products of combustion.

With particular reference to FIGS. 3–7, the tube 42 and fins 46 are preferably constructed of a copper to promote heat transfer. The tube 42 and fins 46 can be constructed of a copper alloy or any other metallurgical mixture containing copper. Preferably, the fins 46 extending from the heat exchange conduit or tube 42 comprise pure copper, although the fins 46 may also comprise different copper alloys. The conduit or tube 42 of the heat exchanger 18 may comprise copper, although a copper alloy is more typical. For example, the copper alloy may comprise zinc oxides and irons. In a preferred embodiment, the copper fins 46 comprise about 99.95 percent copper with a trace of phosphorus (material specification ASTM B75), and the copper conduit 42 comprises about 84 to about 86 percent copper, about 4 to about 6 percent tin, about 4 to about 6 percent zinc, about 4 to about 6 percent lead and some trace amounts of iron (material specification ASTM B62).

A chemical deposition process is used to coat an anti-corrosive outer layer 54 onto the copper tube 42 and/or fins 46. The anti-corrosive outer layer may comprise an electroless nickel, cobalt, palladium, platinum or a combination thereof, although electroless nickel is most preferred. In other words, cobalt, palladium, platinum and combinations thereof can be used as substitutes for nickel. Alternatively, a poly alloy may be applied to the heat exchanger using the methods described herein. The poly alloy may comprise combinations of nickel, boron or phosphorus and other metals such as cobalt, iron, tungsten, molybdenum and combinations thereof.

Before chemical disposition takes place, however, a conventional cleaning process is used to remove dirt and impurities from the exterior surface of the copper heat exchanger 18. The cleaning process itself may comprise a variety of electrical, alkaline and/or acid cleaning steps. The purpose of the cleaning process is to provide a clean, contaminant-free copper surface to which the electroless-nickel coating can properly adhere. Optionally, a copper or nickel strike may be employed to initiate or promote adhesion. Typically, the copper or nickel strike is conducted for approximately 4–5 minutes under 4–5 volts at a temperature of about 140 to 180 degrees Fahrenheit. The copper or nickel strike provides a very thin layer of copper or nickel, which initiates and promotes adhesion.

Next, the coiled, copper-based heat exchanger 18 is introduced into an aqueous chemical disposition bath as part of the electroless-chemical-deposition process. In an alternative embodiment of the invention, raw copper or a copper-based alloy may be immersed in the bath, and then later fabricated into the heat exchanger 18. Either way, the coating process provides a uniform coating to the exterior surfaces of the heat exchanger 18. The preferred coating process is an electroless-chemical-deposition process whereby nickel forms a protective coating on the copper without the use of a constant electrical current during the majority of the process. The electroless-chemical deposition is different from an electro-deposition process, whereby an electrical current is used consistently throughout the deposition process. Instead, an initial electrical current is used only at the very start of the deposition process in order to facilitate the initiation of the deposition reaction. Generally, electrical current of about 6 watts is supplied to the bath for no more than 30 seconds at the start of the electroless-deposition process. Subsequently, no electrical current is provided. Although electroless-deposition processes are preferred, electroplating methods and vacuum deposition methods may be used to apply the corrosion-resistant coating. In one embodiment, no electrical current is used during at least three quarters of the chemical deposition process. Electroless-deposition is preferred because electroplating techniques may clog the space between the tips of the fins of the heat exchangers, may not uniformly distribute the coating on the copper and may also create voids.

Generally speaking, any aqueous bath comprising nickel ions is suitable for use with the electroless-chemical-deposition methods described herein. Alternatively, cobalt, palladium and platinum can be used instead of or combined with nickel. As a result, the discussion pertaining to the use of nickel herein also applies to using cobalt, palladium and platinum. Preferably, the bath comprises both nickel and phosphorus, although the presence of phosphorus in the bath is not required. Nickel, as well as phosphorus, tend to improve the anti-corrosive characteristics of the resulting coating. In addition, the aqueous solution may also include sodium hypophosphite, an acid as well as other boron additives or derivatives as discussed below.

In one embodiment, nickel sulfate provides the requisite nickel ions to the solution. Nickel sulfate, and more particularly nickel, is generally preferred in a concentration of about 20 to about 100 grams per liter of solution, and more particularly about 80 to about 90 grams per liter. Other compounds containing nickel can also be used to supply the nickel to the bath. Nickel is preferred because it possesses a coefficient of thermal expansion that is similar to that of copper. These two elements are also similarly situated on the periodic table of elements, and therefore, share similar chemical and physical properties. In addition, nickel has a heat of evaporization that is greater than, but also similar to, copper. More particularly, the heat of evaporization of copper is about 300.3 kilijoules per mole, while the heat of evaporization of nickel is about 370.4 kilijoules per mole. Because nickel has a greater heat of evaporation, it tends to protect the copper onto which it is coated. The compatibility of these elements results in an anti-corrosive coating that does not inhibit the heat transfer of the copper.

Sodium hypophosphite is generally preferred in the bath in a concentration of about 10 to about 40 grams per liter of solution. More preferably, the sodium hypophosphite is present in the solution in a concentration of about 15 to about 20 grams per liter. The greater the amount of phosphorus in the resulting coating, the duller the final appearance thereof. The intended brightness of the resulting electroless-nickel coating may dictate the amount of phosphorus to be used in the solution.

The presence of acid in the bath is also preferred in order to facilitate chemical deposition. A preferred concentration of the acid is about 20 to about 40 grams per liter of solution, and more preferably about 25 to about 35 grams per liter. One preferred acid is formic acid, although other acids are also suitable for use in the solution.

In addition, other boron additives or derivatives may be added to the solution. Examples of boron derivatives include boron hydrate and sodium borohydrite. Generally, residual amounts of boron derivatives are present in the bath solution, e.g. concentrations of about 0.3 grams to about 0.9 grams per liter of solution. The boron additives enhance finishing, minimize porosity and provide uniformity in the nickel coating.

The remainder of the deposition solution is water and impurities.

The heat exchanger 18 is immersed in this chemical-deposition bath or solution in order to coat the copper exterior of the heat exchanger 18 with the electroless-nickel coating. Except for an initial, brief exposure to electrical current, an electrical current is not introduced into the bath for the majority of the chemical-deposition-bath process. The initial electrical current is not required, but can be used to accelerate the process.

The temperature at which the bath is kept during the chemical deposition process may vary. Preferably the temperature ranges from about 80 to about 210 degrees Fahrenheit, although a temperature range of about 140 to 210 degrees Fahrenheit is more preferred, and a temperature of about 160 to about 190 degrees Fahrenheit is most preferred. The pH of the solution bath is typically maintained in a range of 2.0–14.0, although a range of 3.0–6.0 is most preferred for an acid deposition, while 10.0 to 14.0 is preferred for an alkaline deposition.

Length of exposure of the heat exchanger 18 to the bath may also vary. Exposure to the bath may last from 5 minutes to several hours. Exposure to the solution partially dictates the thickness of the resulting electroless-nickel coating.

In addition to nickel, the coating may also comprise some phosphorus if phosphorus is present in the deposition solution. In other words, a tight-knit nickel-and-phosphorus network may form on the copper-based exterior of the heat exchanger 18. Typically, the nickel-and-phosphorus network comprises about 0.01 to about 16 percent phosphorus, and more preferably about 6 to about 9 percent phosphorus, and the remainder nickel. Cobalt, palladium and platinum can be substituted for the nickel in the network. The outer electroless-nickel coating or nickel-phosphorus network typically has a thickness between about 0.05 mils to about 10 mils. More preferably, the thickness of the coating is between about 0.1 mil to about 1.5 mils, and most preferably between about 0.25 mils and about 1 mils.

After being exposed to the deposition solution, the heat exchanger 18 is rinsed with water. A chromium seal may also be used to seal each of the remaining reactant sites.

The corrosion resistance of the present invention provides several advantages over known systems. The nickel coating on the copper provides an excellent combination of corrosion protection and heat transfer. The coating is also environmentally safe and also thermally conductive. In addition, the coating can withstand the extreme temperatures associated with combustion.

As discussed above, in other water heaters, the gases of combustion reach their dew point and cause a corrosive condensate to form on the heat exchanger. In the water heater of the present invention, however, the anti-corrosive coating prevents corrosion. Therefore, cold water can be supplied to the water heater without being preheated. As a result, there is no need for a recirculation pump or control system to route hot water back to the cold-water inlet in the present invention. By using the electroless coating, and more particularly, the electroless nickel coating, cold water can be fed directly to the boiler, thereby eliminating the external plumbing and control circuit. This, in turn, greatly reduces costs, improves thermal efficiency and greatly simplifies the system. More particularly, the resulting water heater is environmentally friendly because less energy is required due to the elimination of the recirculation step. The overall efficiency of the water heater is also greatly enhanced. In addition, manufacturing costs are reduced because the extra plumbing and the control circuit are eliminated.

Other coatings such as organic-silicone polymers and inorganic-silicone technology as well as sol-gel technology including coatings such as epoxy, silicone/epoxy and silicone/acrylic have been tried, but have failed. This is primarily due to insufficient temperature limits or differences in the coefficient of thermal expansion between the copper and the coatings. Again, nickel works well with copper because they possess similar coefficients of thermal expansion as well as other chemical properties.

EXAMPLE

Copper heat exchangers having copper-alloy tubes and essentially pure-copper fins were coated with an electroless-nickel coating and tested for corrosion as discussed below. The copper fins comprised about 99.95 percent copper with a trace of phosphorus (material specification ASTM B75), and the copper tubes comprised about 84 to about 86 percent copper, about 4 to about 6 percent tin, about 4 to about 6 percent zinc, about 4 to about 6 percent lead and some trace amounts of iron (material specification ASTM B62). The copper heat exchangers were cleaned before being exposed to the chemical-deposition baths discussed below.

Chemical-deposition baths comprising about 84.26 grams of nickel sulfate, about 15.9 grams of sodium hypophosphite, about 27.62 grams of formic acid and about 800 grams of water per liter of solution were used in the tests. The temperature of the baths was maintained between 160 to 190 degrees Fahrenheit at a pH of about 4.4 to 4.6. The copper heat exchangers were then immersed in the bath for about 30 to 45 minutes. The chemical-deposition process yielded coatings having a thickness between 0.25 and 0.75 mils depending on the amount of time each heat exchanger was exposed to the bath.

The coated heat exchangers were then tested in a laboratory. More specifically, the nickel-coated-copper heat exchangers were tested for 12 cycles of 1 hour at 1000 degrees Fahrenheit and followed by a cold water quench. The coated heat exchangers successfully passed this test, and showed reduced signs of green corrosion and rust compared to copper heat exchangers having no protective electroless-nickel coating. In another test, the nickel-coated-copper heat exchangers were exposed to about 4000 hours of a salt spray test. More particularly, ASTMB-117 Salisbury testing methodology was followed to test the affects of corrosion on the heat exchanger. Again, the heat exchangers exhibited improved corrosion resistance.

We claim:

1. A method of preventing corrosion of a copper heat exchanger for a water heater, the method comprising:

immersing a copper heat exchanger into an aqueous-chemical-deposition bath comprising at least one of nickel, cobalt, palladium, platinum and combinations thereof; and electroless-chemically depositing an electroless coating comprising at least one of nickel, cobalt, palladium, platinum and combinations thereof onto at least a portion of the heat exchanger, whereby the electroless coating substantially prevents corrosion of the heat exchanger when the heat exchanger is used in conjunction with a functioning water heater.

2. The method of claim 1, wherein the electroless coating is about 0.05 mils to about 10 mils in thickness.

3. The method of claim 2, wherein the electro less coating is about 0.1 mils to about 1.5 mils in thickness.

4. The method of claim 3, wherein the electroless coating is about 0.25 to about 1.0 mils in thickness.

5. The method of claim 1, wherein the chemical-deposition bath further comprises phosphorus.

6. The method of claim 5, wherein the electroless coating comprises an electroless nickel-phosphorus network.

7. The method of claim 6, wherein the heat exchanger is a copper-coiled heat exchanger having heat-transfer fins, the heat-transfer fins having the electroless coating applied thereon.

8. The method of claim 7, wherein the electroless nickel-phosphorus network comprises about 0.01 to about 16 percent phosphorus.

9. The method of claim 8, wherein the electroless nickel-phosphorus network comprises about 6 to about 9 percent phosphorus.

10. The method of claim 1, wherein the chemical-deposition bath further comprises sodium hypophosphite, an acid, a boron derivative and water.

11. The method of claim 10, wherein the bath comprises about 20 to about 100 parts of nickel per liter of solution, about 10 to 40 parts of sodium hypophosphite per liter of solution, and about 20 to about 40 parts of acid per liter of solution.

12. The method of claim 11, wherein the bath comprises about 80 to about 90 parts of nickel per liter of solution, about 15 to about 20 parts of sodium hypophosphite per liter of solution and about 25 to about 35 parts of acid per liter of solution.

13. The method of claim 1, whereby no electrical current is used during at least three quarters of the chemical deposition process.

14. The method of claim 1, whereby an electrical current is used initially after the heat exchanger is immersed in the bath, but for no more than thirty seconds.

15. The method of claim 1, whereby the electroless coating can withstand high temperatures associated with products of combustion.

16. The method of claim 1, wherein the electroless coating comprises nickel, boron or phosphorus and at least one other metal selected from the group consisting of cobalt, iron, tungsten and molybdenum.

17. A method of manufacturing a water heater, the method comprising:

electroless-chemically depositing an electroless coating onto a portion of a coiled copper heat exchanger, the heat exchanger having a conduit through which water runs and heat-transfer fins extending therefrom; and positioning the heat exchanger into a housing, the housing having a flue positioned above a combustor therein, wherein the coating substantially inhibits corrosion of the exchanger.

18. The method of claim 17, wherein the coating comprises at least one of nickel, cobalt, palladium, platinum and combinations thereof.

19. The method of claim 18, wherein the coating comprises at least one of nickel and a compound thereof.

20. A method of inhibiting corrosion of a coiled copper heat exchanger for a water heater, the method comprising:

immersing at least a portion of the coiled copper heat exchanger into an aqueous-chemical-deposition bath comprising at least one of nickel, cobalt, palladium, platinum and combinations thereof; and electroless-chemically depositing an electroless coating onto at least a portion of the heat exchanger, wherein no electrical current is applied during the majority of the electroless-chemical deposition, the coating comprises at least one of nickel, cobalt, palladium, platinum and combinations thereof, and the coating substantially inhibits corrosion of the heat exchanger when the heat exchanger is used in conjunction with a functioning water heater.

21. The method of claim 1, wherein the heat exchanger includes heat-transfer fins having an outer surface, and the coating is deposited on the outer surface of at least one fin.

22. The method of claim 21, wherein a plurality of the fins are crimped, and have the coating thereon.

23. The method of claim 17, wherein the coating is deposited on at least one heat-transfer fin.

24. The method of claim 23, wherein a plurality of the fins are crimped, and have the coating thereon.

25. The method of claim 20, wherein the heat exchanger includes heat-transfer fins having an outer surface, and the coating is deposited on the outer surface of at least one fin.

26. The method of claim 25, wherein a plurality of the fins are crimped, and have the coating thereon.

27. A method of improving the functioning of a heat exchanger for a water heater, the method comprising:

crimping a plurality of heat-transfer fins on a copper heat exchanger to form crimped fins for improving heating efficiency of the heat exchanger; and electroless-chemically depositing an electroless coating onto a plurality of the crimped fins, the coating comprising at least one of nickel, cobalt, palladium, platinum and combinations thereof.

* * * * *